US008568095B2

(12) United States Patent
Bushnell

(10) Patent No.: US 8,568,095 B2
(45) Date of Patent: Oct. 29, 2013

(54) REDUCED TIP CLEARANCE LOSSES IN AXIAL FLOW FANS

(75) Inventor: Peter R. Bushnell, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 919 days.

(21) Appl. No.: 12/521,314

(22) PCT Filed: Mar. 2, 2007

(86) PCT No.: PCT/US2007/005551
§ 371 (c)(1),
(2), (4) Date: Jun. 26, 2009

(87) PCT Pub. No.: WO2008/082428
PCT Pub. Date: Jul. 10, 2008

(65) Prior Publication Data

US 2010/0068028 A1 Mar. 18, 2010

(51) Int. Cl.
*F04D 29/38* (2006.01)

(52) U.S. Cl.
USPC ..... 415/228; 416/235

(58) Field of Classification Search
USPC ..... 415/173.1, 173.6, 174.2, 57.3, 57.4, 415/170.1, 173.5; 416/174, 228, 235
See application file for complete search history.

(56) References Cited

U.S. PATENT DOCUMENTS

| | | | | |
|---|---|---|---|---|
| 4,238,170 | A | 12/1980 | Robideau et al. | |
| 4,548,548 | A * | 10/1985 | Gray, III | 416/189 |
| 4,571,937 | A * | 2/1986 | Albers | 60/806 |
| 5,226,783 | A * | 7/1993 | Mita | 416/223 R |
| 5,238,364 | A * | 8/1993 | Kreitmeier | 415/173.1 |
| 5,489,186 | A * | 2/1996 | Yapp et al. | 415/58.7 |
| 5,577,888 | A | 11/1996 | Capdevila et al. | |
| 6,508,624 | B2 * | 1/2003 | Nadeau et al. | 415/173.3 |
| 6,832,890 | B2 * | 12/2004 | Booth | 415/173.1 |
| 7,086,825 | B2 | 8/2006 | Wang et al. | |
| 7,946,825 | B2 * | 5/2011 | Tudor | 416/223 A |
| 2004/0009062 | A1 * | 1/2004 | Cho et al. | 415/173.1 |
| 2004/0028526 | A1 * | 2/2004 | Teramura et al. | 415/220 |
| 2005/0002780 | A1 * | 1/2005 | Tanaka | 415/173.1 |
| 2005/0074333 | A1 * | 4/2005 | Iwasaki et al. | 416/179 |

OTHER PUBLICATIONS

International Search Report and Written Opinion mailed Jan. 15, 2008 (7 pgs.).

* cited by examiner

*Primary Examiner* — Edward Look
*Assistant Examiner* — Aaron R Eastman
(74) *Attorney, Agent, or Firm* — Cantor Colburn LLP

(57) ABSTRACT

An axial fan assembly including a casing wall with a forward facing step formed therein and a fan rotor with blade tips, each having an aft facing step which radially overlaps the casing step so as to reduce the clearance backflow loss in the assembly. A vane is attached to the suction side of each of the blade tips with the vane having an aft facing step which radially overlaps the casing forward facing step to promote further reduction of clearance backflow. Variations on the invention include the option of an additional inlet bellmouth piece that further restricts the clearance flow and wedges integral to the casing step to improved flow stability.

13 Claims, 7 Drawing Sheets

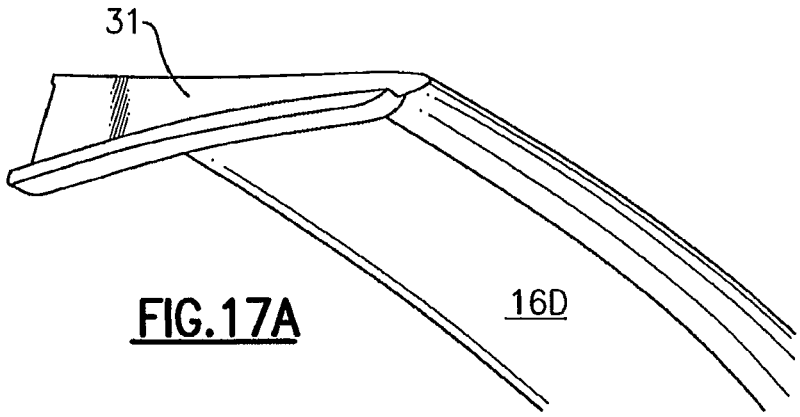
FIG.17A
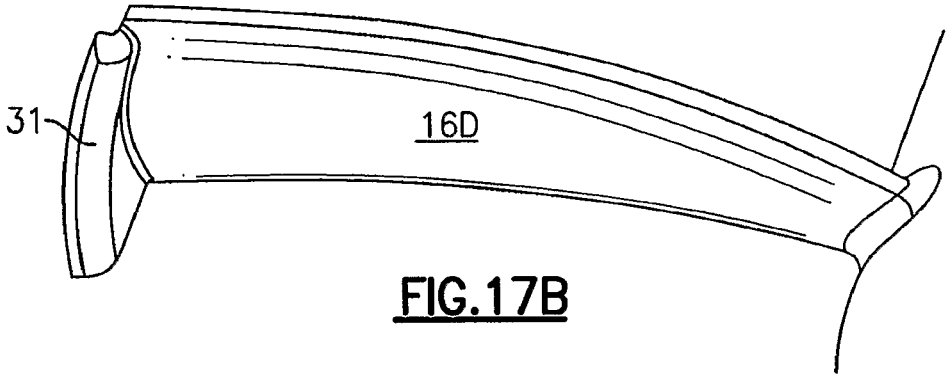
FIG.17B
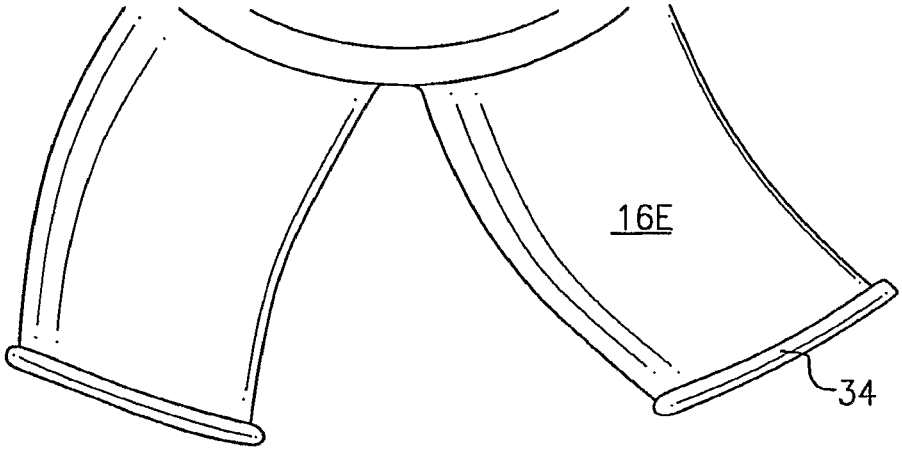
FIG.18
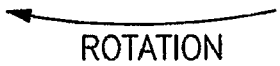

REDUCED TIP CLEARANCE LOSSES IN AXIAL FLOW FANS

BACKGROUND OF THE INVENTION

This invention relates generally to axial flow fans and, more particularly, to a method and apparatus for reducing their clearance flow losses.

Axial flow fans are used in a wide variety of applications, including HVAC, refrigeration, automotive, power systems and aerospace. In each of these applications, efficiency and space limitations are especially important considerations.

Significant efficiency loss occurs in axial flow fans due to backflow in the clearance region between the fan rotor and the casing. The rotor may utilize conventional blades that extend outward with blade tips approaching the casing, or it may utilize blades that include a rotating shroud attached to the blade tips. In either case backflow is driven from the high pressure side of the rotor to the suction side across the clearance gap, leading to reduced performance, increased noise level and reduced stability and stall-margin.

Various designs have been proposed for increasing fan efficiency by reducing or controlling clearance flows. The designs generally involve an interruption or decrease in the size of the gap. One approach is the use of a tip seal structure wherein a circumferentially extending groove in the casing circumscribes the tips of the blades as shown and described in U.S. Pat. No. 4,238,170. In another approach, an axial fan is provided with a casing having a bellmouth, and the shroud is so formed as to create a separation bubble between the bellmouth and the shroud in order to limit the circulation flow as shown in U.S. Pat. No. 7,086,825 assigned to the assignee of the present invention.

Fan stability is affected by rotating flows within the clearance gap. These flows tend to develop into organized rotating cells which can lead to strong through-flow oscillations and excessive noise.

Various designs have been proposed to improve fan stability by controlling these rotating flows. These designs are generally classified as casing treatment.

SUMMARY OF THE INVENTION

Briefly, in accordance with one aspect of the invention, a sharp, forward facing step is provided in the fan casing which, when combined with an overlapping rearward facing step in the fan blade tips, tends to disrupt the backflow so as to thereby restrict clearance flow loss.

In accordance with another aspect of the invention, each of the blades has an attached vane on its suction side, with the vanes having a rearward facing step that overlaps the casing forward facing step.

In the drawings as hereinafter described, a preferred embodiment is depicted; however, various other modifications and alternate constructions can be made thereto without departing from the spirit and scope of the invention.

BRIEF DESCRIPTION OF THE DRAWINGS

FIGS. 17A and 17B are other perspective views thereof.

FIG. 18 is an axial end view of another alternative embodiment of the invention.

DETAILED DESCRIPTION OF THE INVENTION

Figure 1:
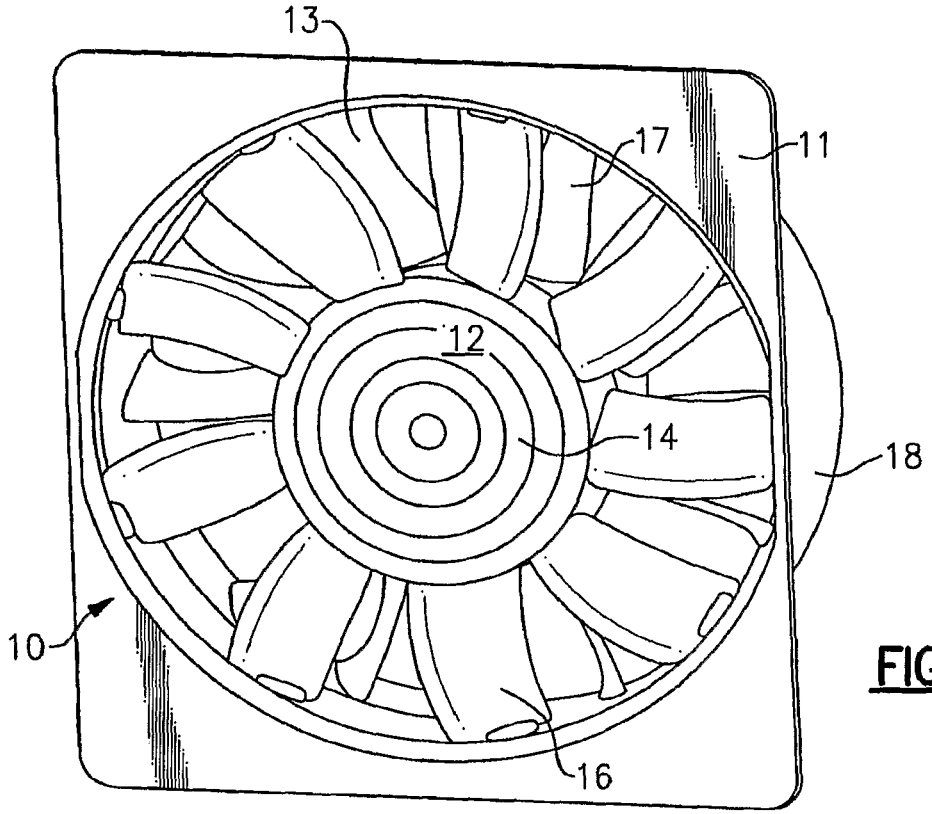
FIG. 1 is a perspective view of an axial fan assembly in accordance with the present invention.
Figure 2:
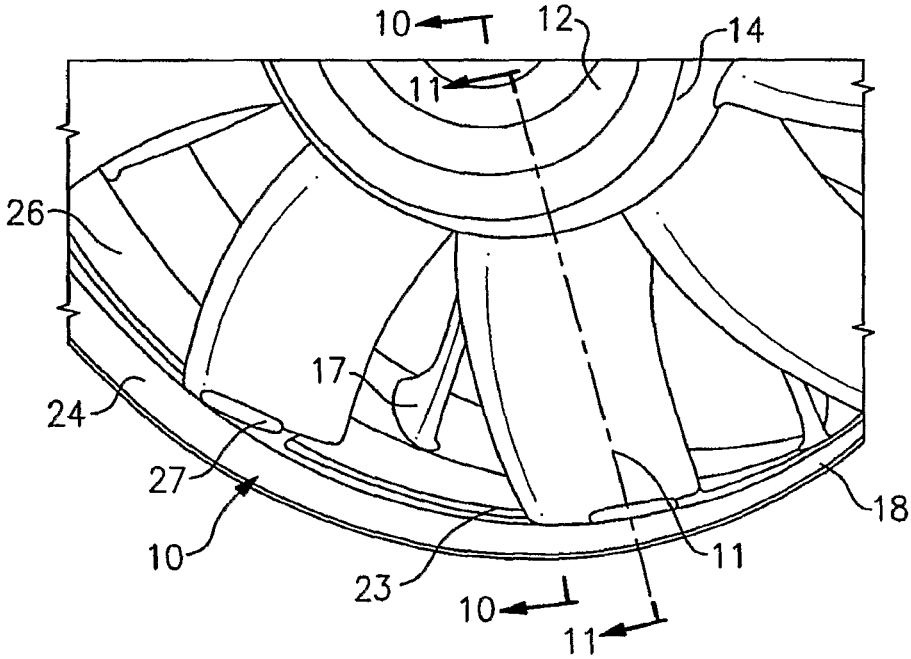
FIG. 2 is an enlarged view of a portion thereof.

Referring to FIGS. 1 and 2, the invention is shown generally at 10 as applied to an axial fan assembly 11 that includes in serial airflow relationship an axial fan 12 and a stator 13. The axial fan 12 includes a rotatable hub 14 and a plurality of fan blades 16. The stator 13 includes a stationary hub and a plurality of radially extending stationary vanes 17 having their radially outer ends integrally connected to a cylindrical outer housing 18. In operation, the fan 12 is rotated at relatively high speeds to induce the flow of air through the casing 18, and in the process it creates a swirl in the direction of the fan rotation. The stator vanes 17 are so disposed and shaped as to substantially remove the swirl from the main airflow stream such that the flow at the downstream end is substantially axial in direction.

As is well known in the art, the dimensions of the axial fan 12 are such that the radial clearance between the ends of the fan blades 16 and the inner diameter of the casing 18 are as small as possible but without engagement between the two elements. Because of this necessary radial clearance, there is a tendency for the air within the casing 18 to flow back through the radial gap to the forward side of the fan 12. This results directly in reduced pressure rise and efficiency. The present invention is intended to significantly reduce the backflow.

Figure 3A:
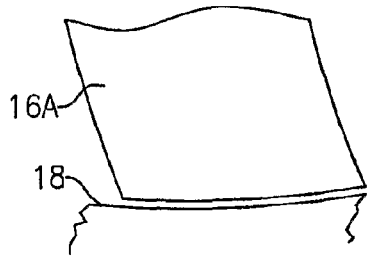
FIGS. 3A and 3B are respective front and end views of a normal blade tip.
Figure 3B:
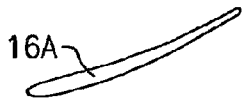
Figure 3C:
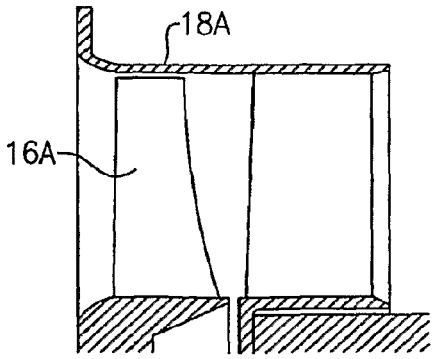
FIG. 3C is an axial cross sectional view thereof in relationship to the casing.

Referring now to FIGS. 3A and 3B, a normal blade is shown at 16A, with a generally planar tip being shown in FIG. 3B. That is, the blade tip is slightly curved to accommodate the curved inner diameter of the casing 18A, but is of a substantially constant radius throughout the length of the blade tip. The blade tip of blade 16A in combination with a standard casing 18A is shown in FIG. 3C.

Figure 4A:
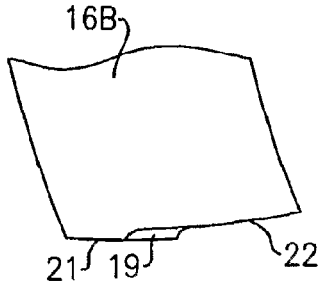
FIGS. 4A and 4B are respective front and end views of a blade tip with a step in accordance with the present invention.
Figure 4B:
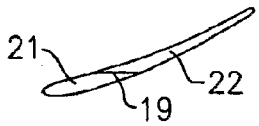

In FIGS. 4A and 4B, the blade 16B is shown to have a blade tip with a rearwardly facing (i.e. toward the downstream or pressure side of the blade 16B) step as shown at 19. That is, that portion 21 of the blade tip nearest the leading edge is of one fixed radius and that portion 22 thereof nearest the trailing edge is of a constant reduced radius. The face of the step 19 is generally planar in form and is aligned tangentially (i.e. normal to the fan axis).

Figure 9:
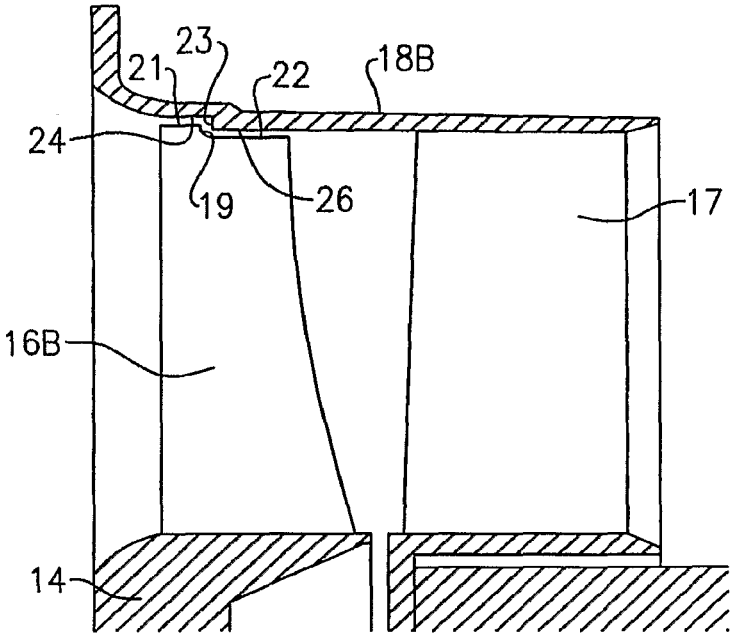
FIG. 9 is an axial cross sectional view of the FIGS. 4A and 4B embodiment of the blade tip in relationship to the casing.

Referring now to FIG. 9, where the blade 16B is shown with its blade tip profile that includes the rearwardly extending step 19 and the leading edge portion 21 and trailing edge portion 22. Here it will be seen that the casing 18B includes a sharp forward facing step 23 which interconnects a larger radius portion 24 and a smaller radius portion 26 of the casing 18B. The sharp forward facing step 23 is a generally planar surface and is aligned tangentially such that the rearwardly facing step 19 is generally parallel with and in close proximity to the sharp forwardly facing step 23. Similarly, the blade tip leading edge portion 21 is closely radially spaced from the larger radius portion 24, and the trailing edge portion 22 of the blade tip is closely radially spaced from the smaller radius portion 26 of the casing 18. This combination is provided for the purpose of reducing the backflow and its associated swirl that would otherwise result in a normal blade tip and casing relationship as shown in FIGS. 3A and 3B.

Figure 5A:
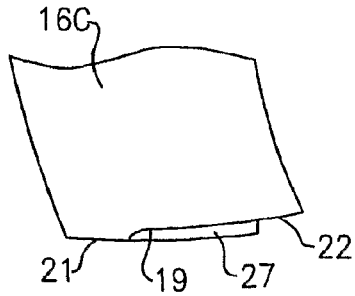
FIGS. 5A and 5B are respective front and end views of a blade tip with a vane in accordance with the present invention.
Figure 5B:
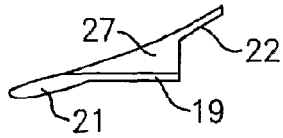

Referring now to FIGS. 5A and 5B, a blade 16C is shown with a rearwardly facing step 19, leading edge portion 21 and trailing edge portion 22 as shown in FIGS. 4A and 4B. However, the blade 16C is further modified to include a vane 27 which is attached to the suction side of the blade as shown in FIG. 2 and which forms part of the blade tip as shown in FIGS. 5A and 5B.

Figure 6:
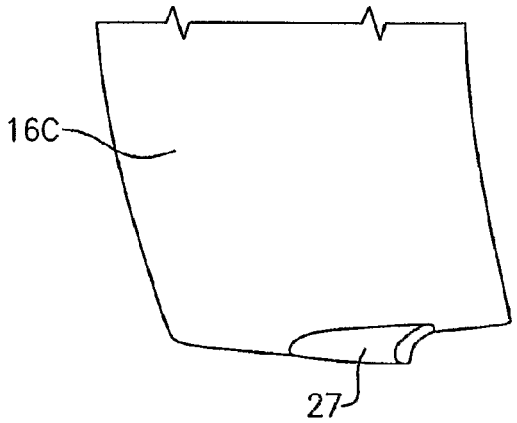
FIG. 6 is a suction side view of a blade tip and vane in accordance with the present invention.
Figure 7:
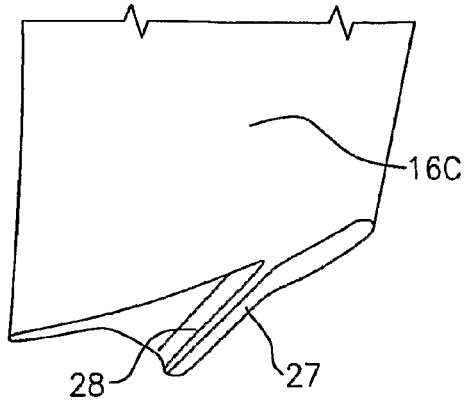
FIG. 7 is a pressure side view of a blade tip and vane in accordance with the present invention.
Figure 8:
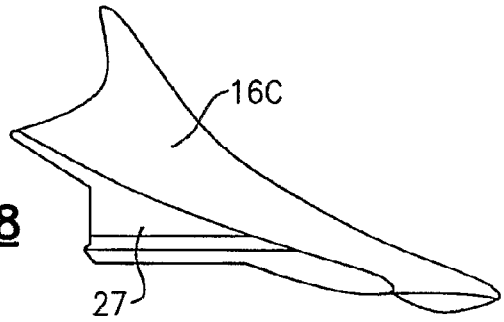
FIG. 8 is a radially inward view of a blade tip and vane in accordance with the present invention.

The vane 27 can best be seen in FIGS. 6, 7 and 8 where it is shown as being attached to the blade 16C. FIG. 6 shows the blade 16 from the suction side, FIG. 7 shows it from the pressure side and FIG. 8 shows it from the radially inward direction as shown in FIG. 8. As will be seen, the vane 27 forms a part of the blade tip and is placed approximately in the middle of the suction side of the blade 16C and extends approximately one-third of the way across. The size and shape of the vane 27 can be selectively varied to meet the particular axial fan assembly and operating requirements.

Figure 10:
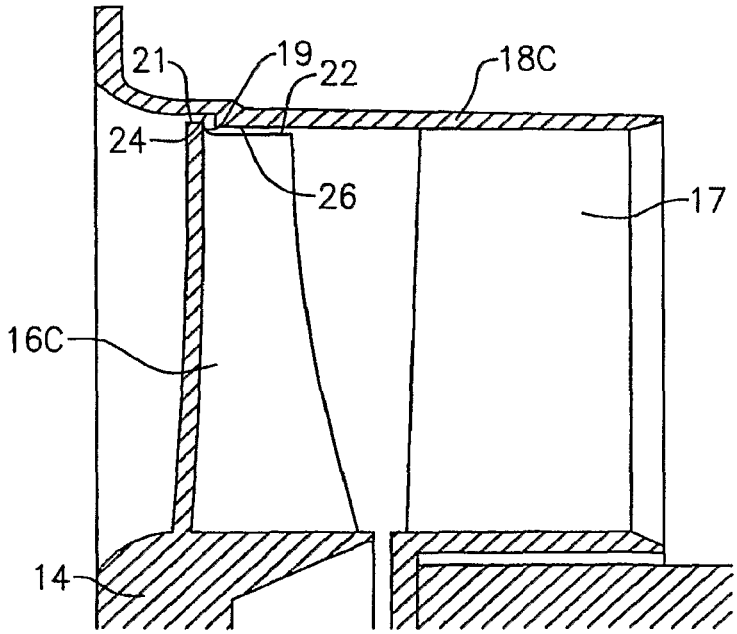
FIG. 10 is an axial cross sectional view as seen along lines 10-10 of FIG. 2.

An important feature of the vane 27 is that it too includes a rearwardly extending step 28 as will be seen in FIG. 7. This step 28 also interfaces with the sharp forward facing step 23 of the casing 18C in a manner similar to the rearwardly facing step 19 of the blade tip as discussed hereinabove to provide a further reduction of backflow that would otherwise occur around the blade tips. This can be seen in FIG. 11 wherein the rearwardly facing step 28 of the vane 27 is closely aligned with the sharp forward facing step 23 of the casing 18C. In order to understand the structure of the blade tip of blade 16C, FIGS. 10 and 11 should be referred to in combination. FIG. 10 is a sectional view through the stepped tip at a point forward of the vane 27, whereas FIG. 11 is a sectional view thereof at a point that includes both the stepped tip and the vane 27.

The design of both the casing and the fan rotor are such that they can be produced using straight-pull tooling (e.g. injection molding or die casting).

Figure 12:
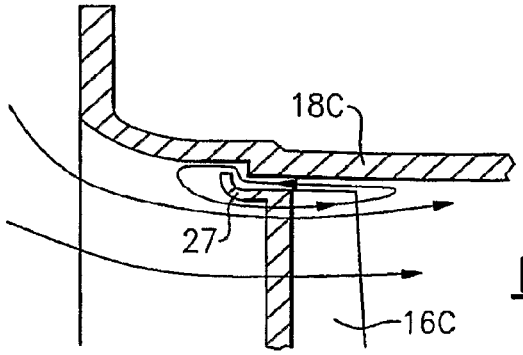
FIG. 12 is a partial view thereof showing the flow of air therein.

In operation, as will be seen in FIG. 12, the relationship of the stepped blade tip and casing produces a convoluted path for the tip clearance leakage flow, which is highly restrictive. The effect is essentially similar to a labyrinth seal where the backflow and recirculation is forced to turn abruptly multiple times. Each flow turning produces a pressure drop which then enables the flow system to withstand a higher differential pressure and a lower leakage loss.

Figure 11:
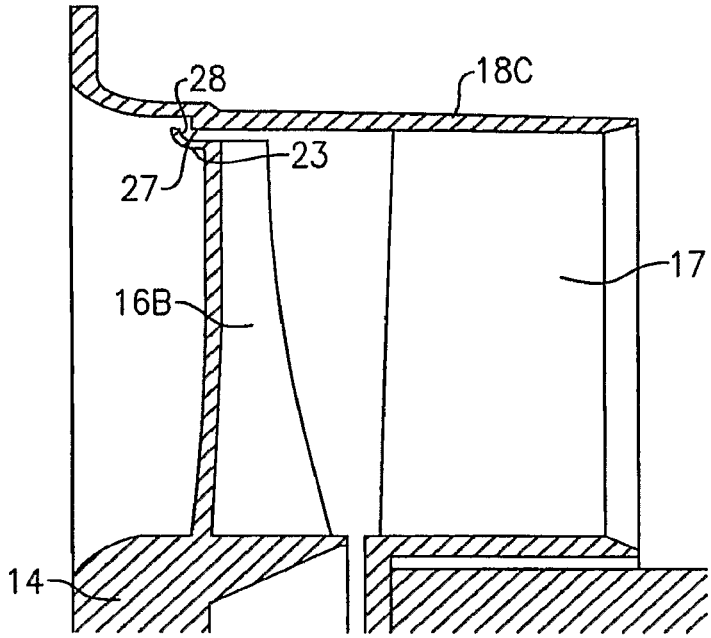
FIG. 11 is an axial cross sectional view as seen along lines 11-11 of FIG. 2.
Figure 13:
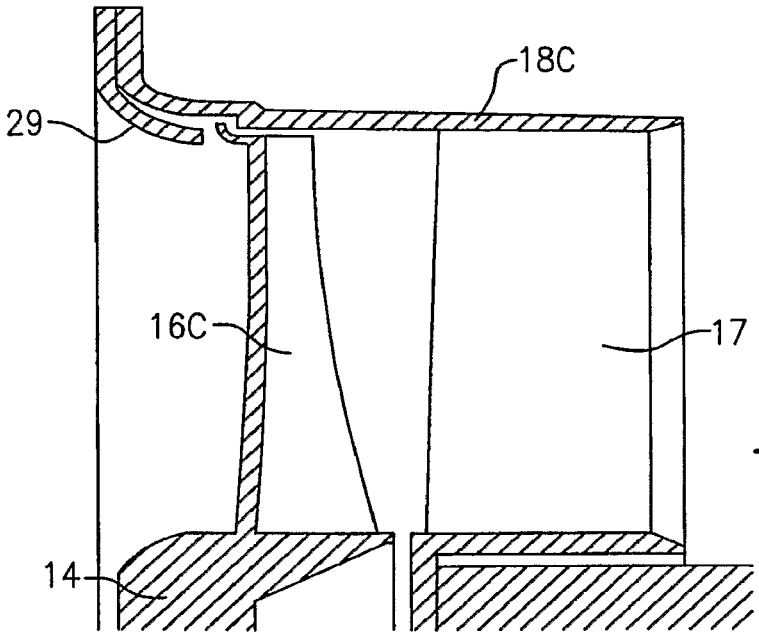
FIG. 13 is an axial cross sectional view of the apparatus as shown in FIG. 11 but with an added inlet bellmouth insert.
Figure 14:
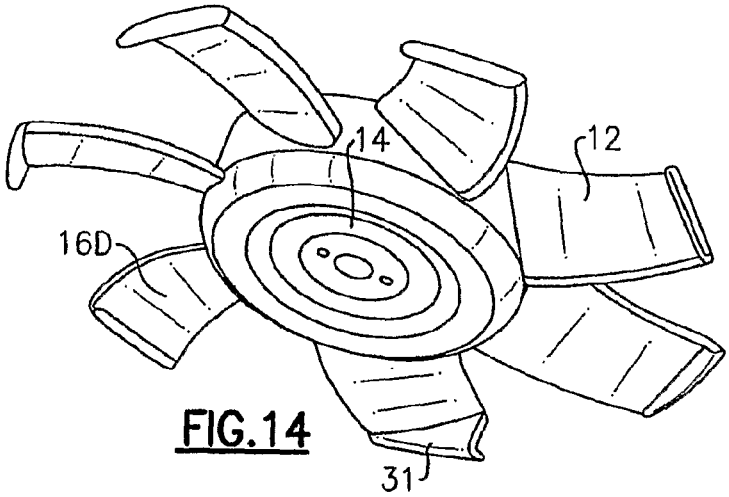
FIG. 14 is a perspective view of an axial fan in accordance with an alternative embodiment of the invention.
Figure 15:
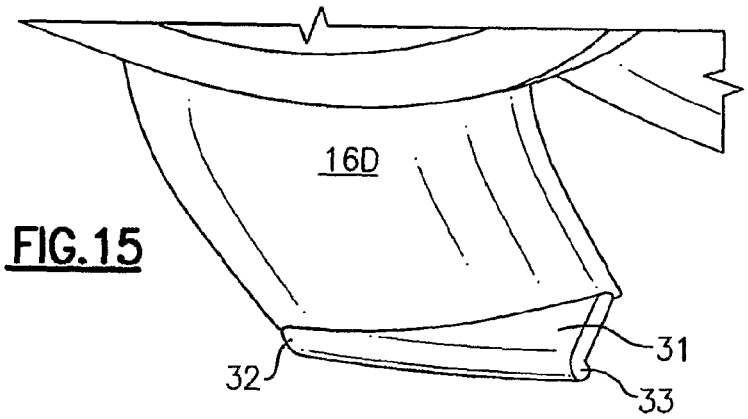
FIG. 15 is an enlarged view of a portion thereof.
Figure 16:
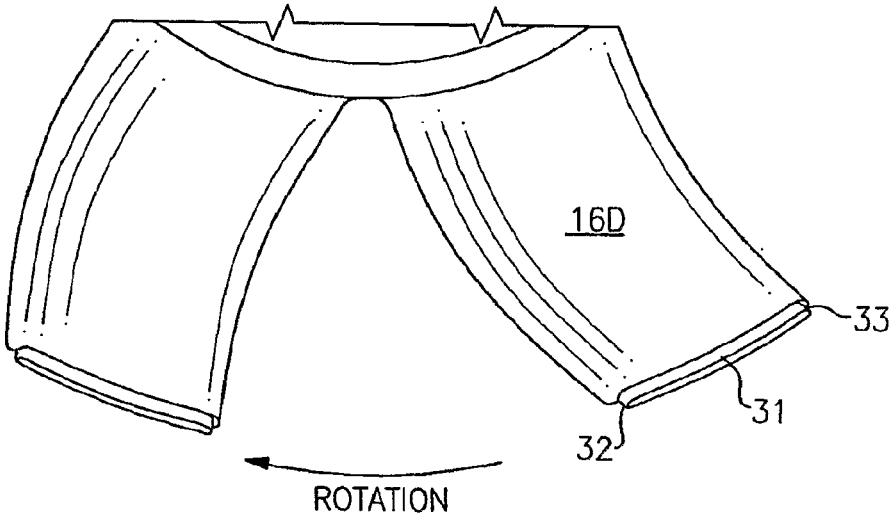
FIG. 16 is an axial end view thereof.

The embodiment of FIG. 11 can be used as shown without the use of inlet bellmouth insert. It will operate similarly but will benefit from the further use of an inlet bellmouth insert 29 as shown in FIG. 13.

An alternative embodiment of the present invention is shown in FIGS. 14-17 wherein the fan blades 16D have a blade tip vane 31 which extends almost the full tangential span of the blade tip. That is, ends 32 and 33 extend to just short of the edges of the fan blade 16D as shown. In such a case, the step feature is entirely within the tip vane and not in the blade tip, as shown in FIGS. 17A and 17B wherein the tip vane 31 is located axially forward of the entire blade tip.

In FIG. 18, there is shown an embodiment wherein the size of the tip vane 34 is lengthened along the tangential direction such that it extends at it two ends just beyond the edges of the blade 16E. As discussed hereinabove, this variation is in keeping with the practice of selectively varying the size and shape of the vane to meet the particular axial fan assembly and operating requirements.

It should be understood that the present invention can be used by itself for the reduction of backflow, or it may be used in combination with the wedges that are shown and described in the patent application being filed concurrently herewith and assigned to the assignee of the present invention.

Although preferred and alternative embodiments of the invention have been disclosed and described, one of ordinary skill in the art would recognize that certain modifications would come within the scope of this invention. For that reason, the following claims should be studied to determine the true scope and content of the invention.

I claim:

1. An axial fan apparatus, comprising:

an unshrouded fan having a hub with a plurality of blades extending radially therefrom and terminating at respective blade tips;

a casing closely surrounding said plurality of blades and having formed in its radially inner surface, a forward facing step structure that is axially disposed around said blade tips; and a vane attached at the blade tip of each of the plurality of blades;

each of said vanes having a rearward facing step formed thereon and positioned so as to radially overlap said forward facing step structure.

2. The axial fan apparatus as set forth in claim 1 wherein, for each of said blade tips, said rearward facing step is nearer to a leading edge of said blade than a trailing edge thereof.

3. The axial fan apparatus as set forth in claim 2 wherein said rearward facing step is located approximately one-third of the distance back from said leading edge.

4. The axial fan apparatus as set forth in claim 1 wherein said vane is attached to a suction side of said blade tip.

5. The axial fan apparatus as set forth in claim 4 wherein said vane is attached to a middle portion of said suction side blade tip.

6. The axial fan apparatus as set forth in claim 5 wherein said vane extends over approximately one-third of the tangential span of said suction side blade tip.

7. The axial fan apparatus as set forth in claim 5 wherein said vane extends over nearly the entire tangential span of said suction side blade tip.

8. The axial fan apparatus as set forth in claim 5 wherein said vane extends over at least the entire tangential span of said suction side blade tip.

9. The axial fan apparatus as set forth in claim 1 wherein each vane extends from a respective blade tip in a direction parallel to an airflow direction through the axial fan.

10. The axial fan apparatus as set forth in claim 9 wherein each step extends from a respective vane in a direction perpendicular to the airflow direction through the axial fan.

11. The axial fan apparatus as set forth in claim 1 wherein each vane extends from a respective blade tip in a direction perpendicular to the blade.

12. The axial fan apparatus as set forth in claim 11 wherein each step extends from a respective vane in a direction perpendicular to the vane.

13. An axial fan apparatus, comprising:

an unshrouded fan having a hub with a plurality of blades extending radially therefrom and terminating at respective blade tips;

a casing closely surrounding said plurality of blades and having formed in its radially inner surface, a forward facing step structure that is axially disposed around said blade tips; and a vane attached at the blade tip of each of the plurality of blades;

each of said vanes having a rearward facing step formed thereon and positioned so as to radially overlap said forward facing step structure;

for each of said blade tips, said rearward facing step is nearer to a leading edge of said blade than a trailing edge thereof;

wherein said vane is attached to a suction side of said blade tip;

wherein each vane extends from a respective blade tip in a direction parallel to an airflow direction through the axial fan;

wherein each step extends from a respective vane in a direction perpendicular to the airflow direction through the axial fan.

* * * * *